US006007212A

United States Patent [19]

Chan

[11] Patent Number: 6,007,212

[45] Date of Patent: Dec. 28, 1999

[54] NOVELTY HAT WITH BLINKING LIGHT

[76] Inventor: Alex Chan, 2021 Pennington Dr., Arlington, Tex. 76014

[21] Appl. No.: 08/664,764

[22] Filed: Jun. 7, 1996

[51] Int. Cl.[6] ..... F21L 15/14

[52] U.S. Cl. ..... 362/106; 362/105; 362/806

[58] Field of Search ..... 362/105, 106, 362/103, 190, 191, 806; 2/209.13

[56] References Cited

U.S. PATENT DOCUMENTS

| | | | |
|---|---|---|---|
| 2,593,188 | 4/1952 | Rikelman | 362/106 |
| 2,640,980 | 6/1953 | Prupis | 362/106 |
| 2,943,186 | 6/1960 | Weiss | 362/106 |
| 3,963,917 | 6/1976 | Romano | 362/105 |
| 4,186,429 | 1/1980 | Johnston | 362/106 |

*Primary Examiner*—Thomas M. Sember

[57] ABSTRACT

A novelty hat with blinking light including a hat portion. A blinking light is secured to the hat portion. The blinking light has wiring extending outwardly therefrom. A battery is coupled with a free end of the wiring of the blinking light. A power switch is coupled with the wiring intermediate the blinking light and the battery.

2 Claims, 3 Drawing Sheets

NOVELTY HAT WITH BLINKING LIGHT

BACKGROUND OF THE INVENTION

1. Field of the Invention

The present invention relates to a novelty hat with blinking light and more particularly pertains to providing a novelty hat with an illuminating ball on an end thereof with a novelty hat with blinking light.

2. Description of the Prior Art

The use of illumination hats is known in the prior art. More specifically, illumination hats heretofore devised and utilized for the purpose of illuminating the hat are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,186,429 to Johnston discloses a flashing light safety device for cyclists helmets.

U.S. Pat. No. 4,406,040 to Cannone discloses illumination devices.

U.S. Pat. No. 3,963,917 to Romano discloses an illuminated safety helmet.

U.S. Pat. No. 2,593,188 to Rikelman discloses a novelty hat construction.

While these devices fulfill their respective, particular objective and requirements, the aforementioned patents do not describe a novelty hat with blinking light for providing a novelty hat with an illuminating ball on an end thereof.

In this respect, the novelty hat with blinking light according to the present invention substantially departs from the conventional concepts and designs of the prior art, and in doing so provides an apparatus primarily developed for the purpose of providing a novelty hat with an illuminating ball on an end thereof.

Therefore, it can be appreciated that there exists a continuing need for new and improved novelty hat with blinking light which can be used for providing a novelty hat with an illuminating ball on an end thereof. In this regard, the present invention substantially fulfills this need.

SUMMARY OF THE INVENTION

In the view of the foregoing disadvantages inherent in the known types of illumination hats now present in the prior art, the present invention provides an improved novelty hat with blinking light. As such, the general purpose of the present invention, which will be described subsequently in greater detail, is to provide a new and improved novelty hat with blinking light and method which has all the advantages of the prior art and none of the disadvantages.

To attain this, the present invention essentially comprises a hat portion having a generally conical configuration. The hat portion has an open head receiving portion and elongated upper portion terminating in an apex. The apex has a channel therethrough. The device includes an ornamental ball portion having a hollow interior. The ball portion has an opening therein exposing the hollow interior thereof. The ball portion is secured to the apex of the hat portion with the opening cooperating with the channel through the apex. A hollow plastic ball is disposed within the hollow interior of the ornamental ball portion. The hollow plastic ball has a shelf disposed within a hollow interior thereof. A blinking light is secured to the shelf within the hollow interior of the plastic ball. The blinking light has wiring extending outwardly therefrom. The wiring extends outwardly of the plastic ball and through the opening in the ornamental ball portion and into the channel of the apex of the hat portion. A battery is secured within the channel of the apex of the hat portion. The battery is coupled with a free end of the wiring of the blinking light. A power switch is secured within the channel of the apex of the hat portion. The power switch has an activation button extending outwardly of the hat portion. The power switch is coupled with the wiring intermediate the blinking light and the battery.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty hat with blinking light which has all the advantages of the prior art illumination hats and none of the disadvantages.

It is another object of the present invention to provide a new and improved novelty hat with blinking light which may be easily and efficiently manufactured and marketed.

It is a further object of the present invention to provide a new and improved novelty hat with blinking light which is of durable and reliable construction.

An even further object of the present invention is to provide a new and improved novelty hat with blinking light which is susceptible of a low cost of manufacture with regard to both materials and labor, and which accordingly is then susceptible of low prices of sale to the consuming public, thereby making such a novelty hat with blinking light economically available to the buying public.

Still yet another object of the present invention is to provide a new and improved novelty hat with blinking light which provides in the apparatuses and methods of the prior art some of the advantages thereof, while simultaneously overcoming some of the disadvantages normally associated therewith.

Even still another object of the present invention is to provide a new and improved novelty hat with blinking light for providing a novelty hat with an illuminating ball on an end thereof.

Lastly, it is an object of the present invention to provide a new and improved novelty hat with blinking light including a hat portion. A blinking light is secured to the hat portion. The blinking light has wiring extending outwardly therefrom. A battery is coupled with a free end of the wiring of the blinking light. A power switch is coupled with the wiring intermediate the blinking light and the battery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
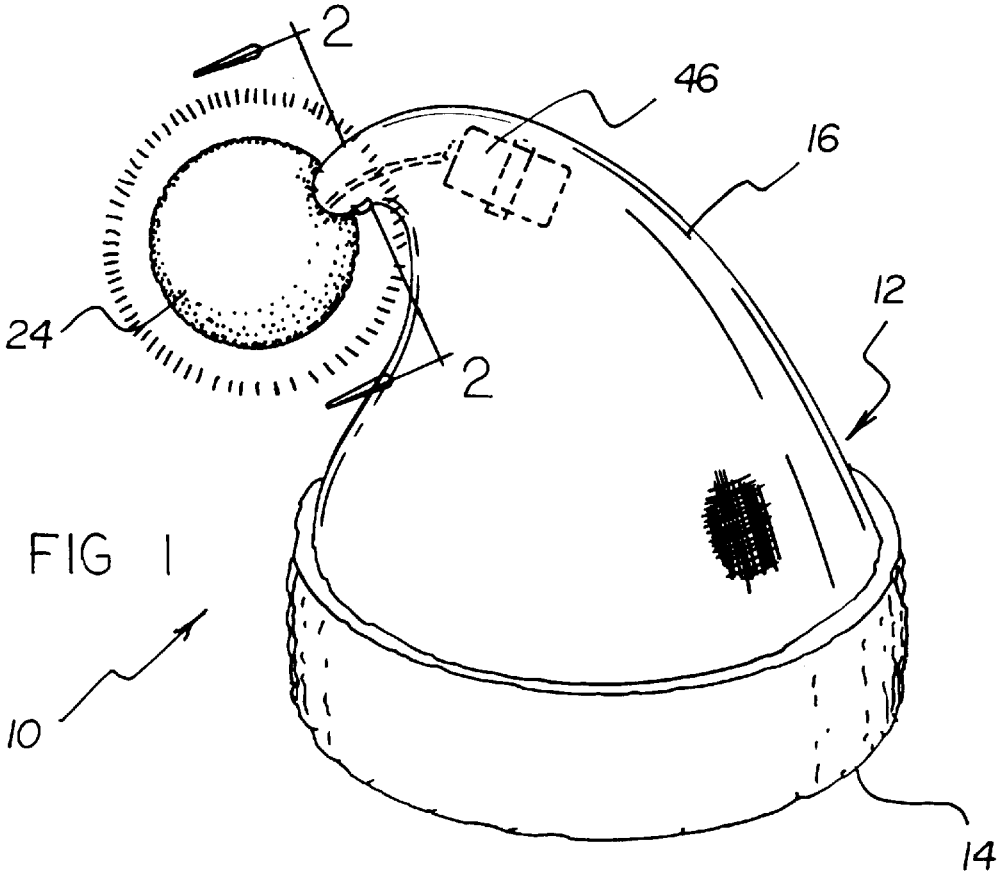
FIG. 1 is a perspective view of the preferred embodiment of the novelty hat with blinking light constructed in accordance with the principles of the present invention.
Figure 2:
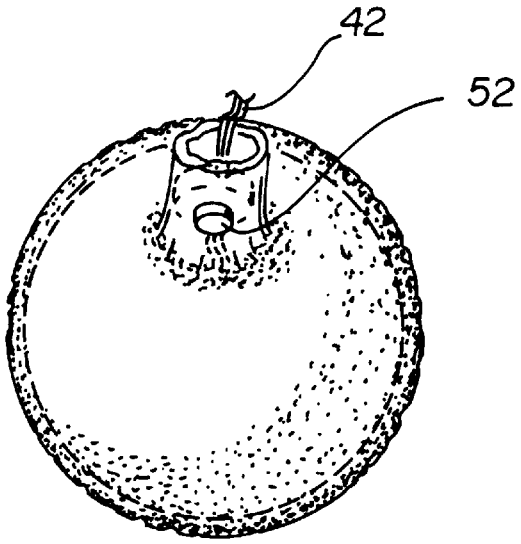
FIG. 2 is a view of the present invention taken along line 2—2 of FIG. 1.
Figure 3:
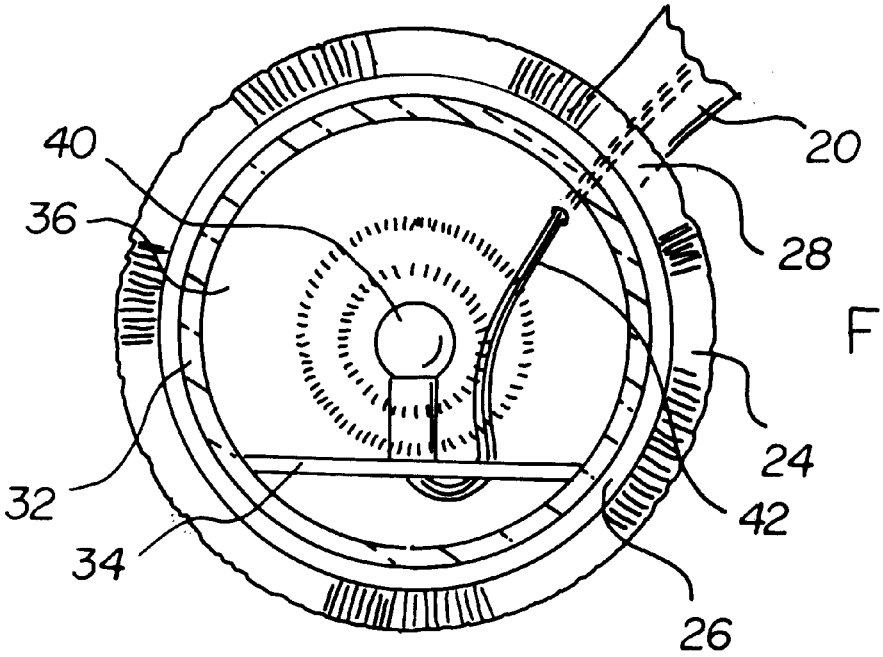
FIG. 3 is a cross-sectional view of the furry ball illustrating the plastic ball and the blinking light therein.

With reference now to the drawings, and in particular, to FIGS. 1–6 thereof, the preferred embodiment of the new and improved novelty hat with blinking light embodying the principles and concepts of the present invention and generally designated by the reference number 10 will be described.

Specifically, it will be noted in the various Figures that the device relates to a novelty hat with blinking light for providing a novelty hat with an illuminating ball on an end thereof. In its broadest context, the device consists of a hat portion, an ornamental ball portion, a hollow plastic ball, a blinking light, a battery and a power switch. Such components are individually configured and correlated with respect to each other so as to attain the desired objective.

The device 10 includes a hat portion 12 having a generally conical configuration. The hat portion 12 has an open head receiving portion 14 and elongated upper portion 16 terminating in an apex 18. The apex 18 has a channel 20 therethrough. The hat portion 12 preferably resembles a santa hat, the type worn during the Christmas season. Other types of hat styles could also be used.

The device 10 includes an ornamental ball portion 24 having a hollow interior 26. The ball portion 24 has an opening 28 therein exposing the hollow interior 26 thereof. The ball portion 24 is secured to the apex 18 of the hat portion 12 with the opening 28 cooperating with the channel 20 through the apex 18. The ornamental ball portion is preferably fabricated of a cotton or synthetic type material that will give the ornamental ball portion 24 a "fuzzy" appearance. The ornamental ball portion 24 is also of a material that is translucent to a light source therein.

Next, a hollow plastic ball 32 is disposed within the hollow interior 26 of the ornamental ball portion 24. The hollow plastic ball 32 has a shelf 34 disposed within a hollow interior 36 thereof.

A blinking light 40 is secured to the shelf 34 within the hollow interior 36 of the plastic ball 32. The blinking light 40 has wiring 42 extending outwardly therefrom. The wiring 42 extends outwardly of the plastic ball 32 and through the opening 28 in the ornamental ball portion 24 and into the channel 20 of the apex 18 of the hat portion 12. The blinking light 40, when illuminated, will shine through the hollow plastic ball 32 and the ornamental ball portion 24.

Next, a battery 46 is secured within the channel 20 of the apex 18 of the hat portion 12. The battery 46 is coupled with a free end of the wiring 42 of the blinking light 40. The battery 46 serves to power the blinking light 40.

Lastly, a power switch 50 is secured within the channel 20 of the apex 18 of the hat portion 12. The power switch 50 has an activation button 52 extending outwardly of the hat portion 12. The power switch 50 is coupled with the wiring 42 intermediate the blinking light 40 and the battery 46. A user simply presses the activation button 52 to illuminate the blinking light 40 and pressing the activation button 52 a second time to deactivate the blinking light 40.

Figure 4:
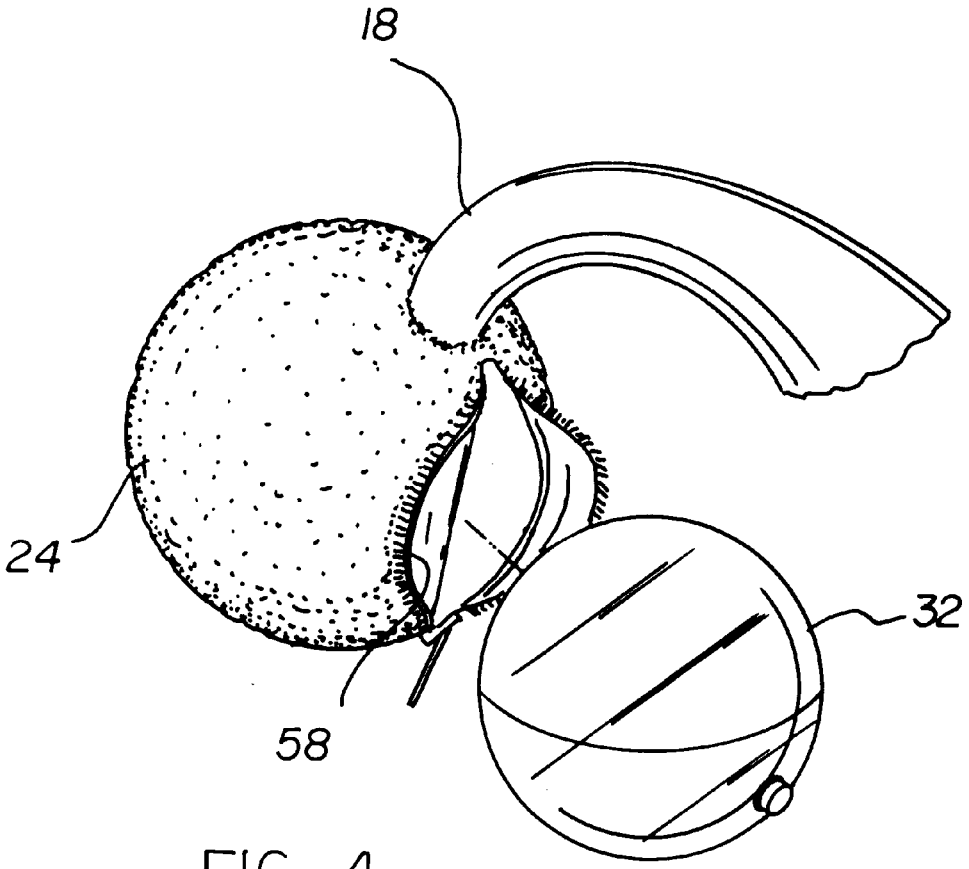
FIG. 4 is a perspective view of a second embodiment of the present invention illustrating removability of the plastic ball.
Figure 5:
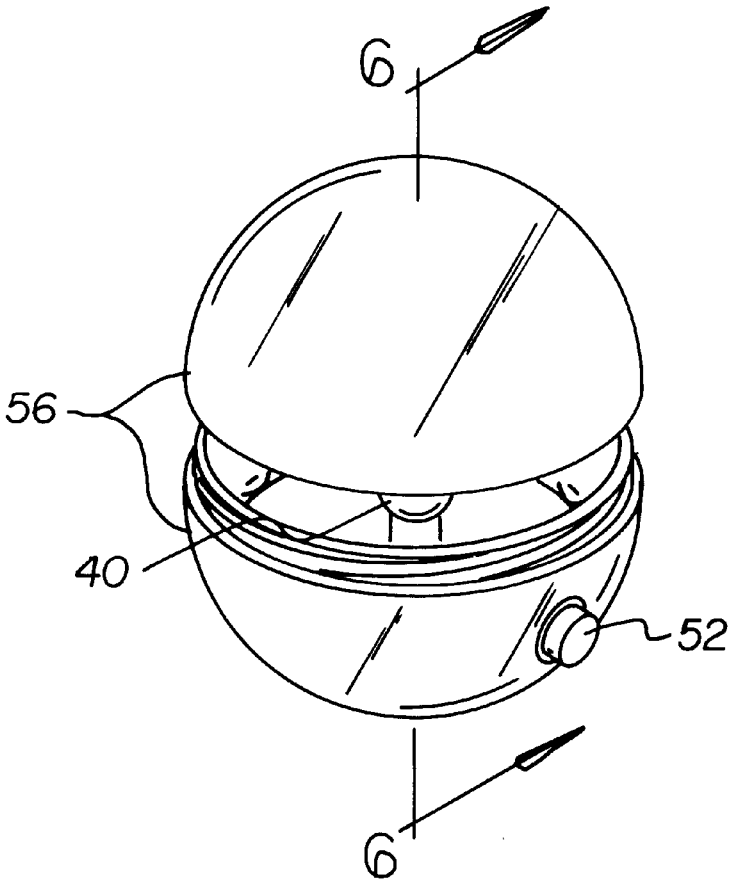
FIG. 5 is an isolated plan view of the plastic ball of the second embodiment of the present invention.
Figure 6:
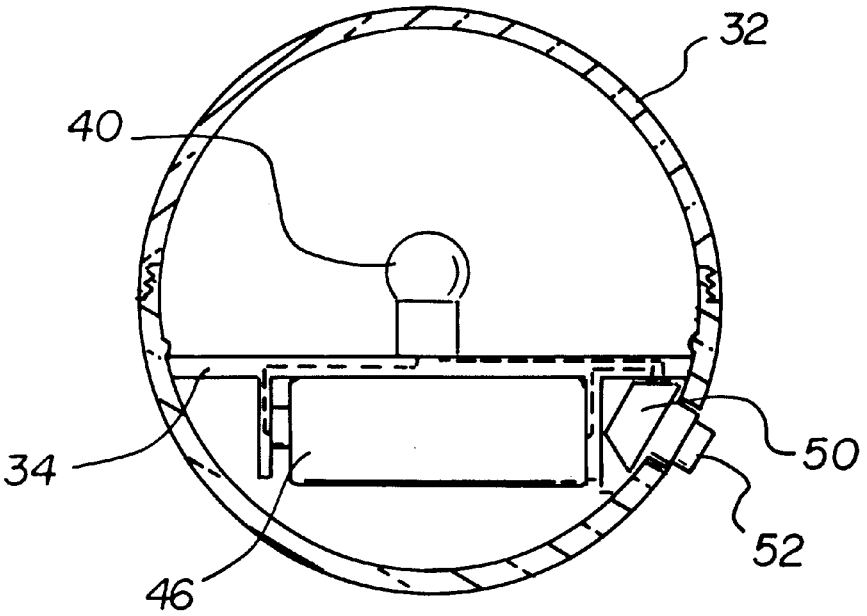
FIG. 6 is a cross-sectional view as taken along line 6—6 of FIG. 5.

A second embodiment of the present invention is shown in FIGS. 4–6 and includes substantially all of the components of the present invention wherein the blinking light 40, the battery 46 and the power switch 50 are disposed within a hollow plastic ball 32. The hollow plastic ball 32 is comprised of two semi-circular portion 56 removably secured together. This will allow the user to change the blinking light 40 or the battery 46 when necessary. The power switch 50 has an activation button 52 extending outwardly of the hollow plastic ball 32. The hollow plastic ball 32 is removably secured within the ornamental ball portion 24 secured to the hat portion 12. The ornamental ball portion 24 has a zippered opening 58 to facilitate removal of the hollow plastic ball 32 therefrom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A novelty hat with blinking light for providing a novelty hat with an illuminating ball on an end thereof comprising, in combination:

a hat portion having a generally conical configuration, the hat portion having an open head receiving portion and elongated upper portion terminating in an apex, the apex having a channel therethrough;

an ornamental ball portion having a hollow interior, the ball portion having an opening therein exposing the hollow interior thereof, the ball portion secured to the apex of the hat portion with the opening cooperating with the channel through the apex;

a hollow plastic ball disposed within the hollow interior of the ornamental ball portion, the hollow plastic ball having a shelf disposed within a hollow interior thereof;

a blinking light secured to the shelf within the hollow interior of the plastic ball, the blinking light having wiring extending outwardly therefrom, the wiring extending outwardly of the plastic ball and through the opening in the ornamental ball portion and into the channel of the apex of the hat portion;

a battery secured within the channel of the apex of the hat portion, the battery being coupled with a free end of the wiring of the blinking light; and a power switch secured within the channel of the apex of the hat portion, the power switch having an activation button extending outwardly of the hat portion, the power switch coupled with the wiring intermediate the blinking light and the battery.

2. A novelty hat with blinking light comprising:

a hat portion;

a blinking light secured to the hat portion, the blinking light having wiring extending outwardly therefrom;

a battery coupled with a free end of the wiring of the blinking light; and a power switch coupled with the wiring intermediate the blinking light and the battery; said blinking light, battery and the power switch being disposed within a hollow plastic ball; said hollow plastic ball comprised of two semi-circular portions removably secured together;

wherein the power switch has an activation button extending from an interior to an exterior outwardly of the hollow plastic ball.

* * * * *